United States Patent [19]

Veltri

[11] 4,428,502

[45] Jan. 31, 1984

[54] LOCKABLE POCKET-SIZE TABLET DISPENSING DEVICE

[76] Inventor: Douglas F. Veltri, 551 Washington St., Carlstadt, N.J. 07072

[21] Appl. No.: 133,880

[22] Filed: Mar. 25, 1980

[51] Int. Cl.[3] ..... B23Q 7/12

[52] U.S. Cl. ..... 221/152; 221/196; 221/266; 74/527

[58] Field of Search ..... 221/151, 152, 153, 266, 221/196; 74/10.2, 813 L, 529, 527, 528

[56] References Cited

U.S. PATENT DOCUMENTS

| | | | |
|---|---|---|---|
| 1,610,717 | 12/1926 | Teabout et al. | 221/152 |
| 1,716,883 | 6/1929 | Gesbeck | 221/266 X |
| 2,407,696 | 9/1946 | Webster | 74/527 |
| 2,511,951 | 6/1950 | Solomon | 221/266 X |
| 2,928,294 | 3/1960 | Garrett | 74/527 |
| 3,359,824 | 12/1967 | Focht | 74/527 |

*Primary Examiner*—Allen N. Knowles

[57] ABSTRACT

A device for dispensing tablets, pills and the like includes an enclosure containing a first cavity to store a plurality of tablets, a second cavity disposed adjacent the first cavity and a second cavity including a dispensing wheel including slots to convey a predetermined quantity of tablets or pills to a discharge opening, a control knob placed adjacent the dispensing wheel for moving the dispensing wheel. The control knob has a knurled surface such that a manual locking arm included in the dispensing device can engage a groove of the knurled surface to prevent rotation of the control knob and inadvertent dispensing of the tablets.

11 Claims, 6 Drawing Figures

11
12
22
42
54
32
36
34
35
56
18
14
58
30
28
26
48
50
52
20
16
13
12

LOCKABLE POCKET-SIZE TABLET DISPENSING DEVICE

BACKGROUND OF THE INVENTION

1. Field of the Invention This invention relates to a dispensing device for pills or tablets in which the pills or tablets are dispensed in a controlled amount. The dispensing device of the present invention enables the tablets to be dispensed by manual movement of a control knob and includes a locking means which prevents inadvertent discharge of the tablets from the dispensing device. The dispensing device can be scaled so as to be a pocket-size tablet dispenser to provide convenient storage and dispensing of a variety of tablets.

2. Disclosure Statement

Dispensing devices containing a rotating ejecting means having one or more notches or recesses for trapping an object from a supply held above the ejecting means are known in the art of dispensing. In U.S. Pat. No. 3,204,834, Gadenne discloses a pocket dispenser comprising a cavity for storing pastilles placed above a dispensing wheel which contains a plurality of recesses to hold the pastilles, the dispensing wheel being rotated by a control knob which is interconnected with the dispensing wheel by a rotatably mounted pivot pin, the control knob extending outwardly from an enclosure which holds the pastilles and dispensing wheel, whereby movement of the control knob moves the dispensing wheel to receive a pastille from the storage cavity and convey the pastilles to a discharge opening in the dispenser enclosure. The dispensing device of Gadenne, however is unlike the present invention as it does not teach the specific structure of the dispensing wheel or include a funnel-shaped member which is placed between a storage cavity and a cavity which holds the dispensing wheel, nor does the above patent teach the unique locking means of the present invention to prevent inadvertent rotation of the control knob and subsequent inadvertent discharge of the tablets or pills.

SUMMARY OF THE INVENTION

Briefly, the dispensing device of the present invention may be of the pocket type and includes a dispensing wheel which receives a predetermined quantity of tablets from a storage cavity and conveys the tablets to a chute which includes a discharge opening in the enclosure of the dispensing device. The tablet dispenser includes a locking means which enables the dispensing device to discharge tablets when desired without inadvertent discharge of the tablets from the device.

More specifically, the dispensing device of the present invention includes an enclosure which contains a first cavity for storing tablets, a second cavity adjacent said first cavity including a dispensing wheel which includes spaced slots for receiving the tablets from the storage cavity, a control knob placed in the second cavity adjacent the dispensing wheel and interconnected therewith by a rotating axle means, a portion of the outer surface of the control knob extending outwardly from the enclosure. The dispensing device further includes a funnel means between the first cavity and dispensing wheel and includes pivotal locking means to enable the manual turning of the control knob thereby enabling the dispensing wheel to receive a tablet from the storage container through said funnel means and to convey said tablet to the chute which includes the discharge opening, the locking means being further able to prevent rotation of the control knob thus preventing inadvertent discharge of the tablets from the enclosure.

Accordingly, it is an object of the invention to provide a dispensing device for tablets, pills and the like which enables the dispensing of a controlled amount of tablets.

It is another object of the invention to provide a tablet dispensing device which can dispense a controlled amount of tablets by manual manipulation of the device.

It is another object of the invention to provide a tablet dispensing device which can dispense a controlled amount of tablets without inadvertent ejection of tablets from the device.

It is a further object of the invention to provide a tablet dispensing device which includes a dispensing wheel able to receive tablets and to convey tablets to a discharge opening, the rotation of the dispensing wheel being controlled by a circular control knob interconnected with the dispensing wheel by a rotatable axle, the control knob being able to be manually controlled and which includes a locking means to prevent rotation of the control knob.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
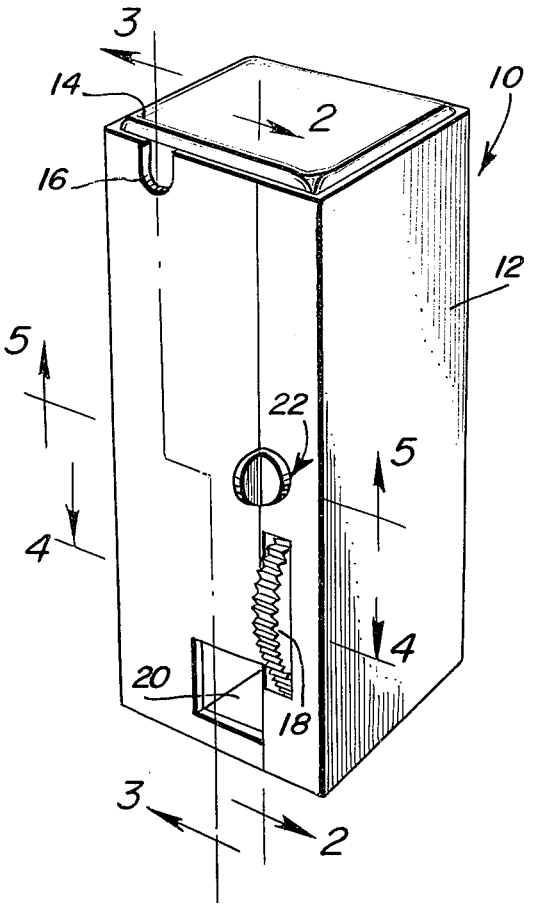
FIG. 1 is a perspective view showing the tablet dispensing device of the present invention.

The tablet dispensing device 10 of the present invention is generally shown in FIG. 1 and is of a rectangular-like configuration that can be scaled so as to fit a pocket for convenient use. Dispensing device 10 includes lateral side walls 12 and removable lid 14 which form an enclosure with the bottom surface to hold the tablets or pills to be dispensed and the component parts of the dispensing device. At least one of lateral side walls 12 includes a notch 16 which enables removable lid 14 which is telescoped into the box-like enclosure formed by side walls 12 to be removed by the use of a finger or thumb and thus enabling the replacement of tablets in the storage compartment of the device. The tablets are dispensed by the user by turning or movement of control knob 18 whereby the tablets will be dispensed from discharge opening 20. Pivotable locking device 22 is turned to permit movement of control knob 18 for dispensing of a predetermined quantity of tablets and can be returned to the lock position whereby the movement of control knob 18 is prevented and thus the tablets or pills will not be inadvertently discharged through discharge opening 20. Control knob 18 includes a knurled outer surface which enables more efficient turning by the fingers or thumb of a user and which enables easy and efficient locking control by pivotable locking device 22 as illustrated in FIG. 2.

Figure 2:
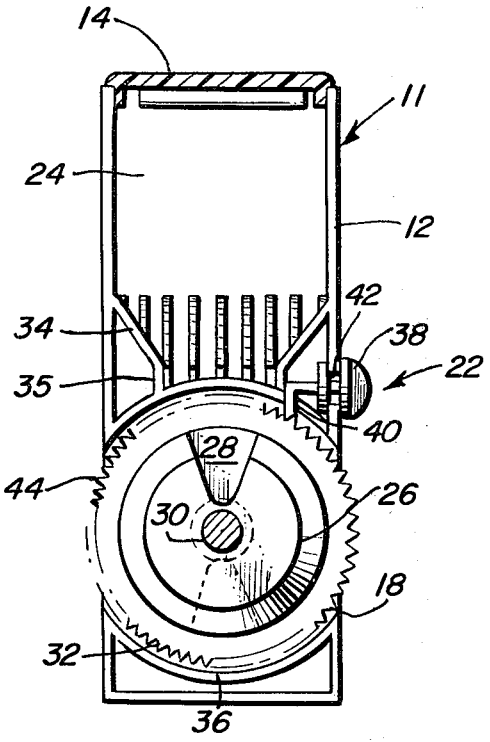
FIG. 2 is a longitudinal sectional veiw of the dispensing device taken generally along line 2—2 of FIG. 1.
Figure 6:
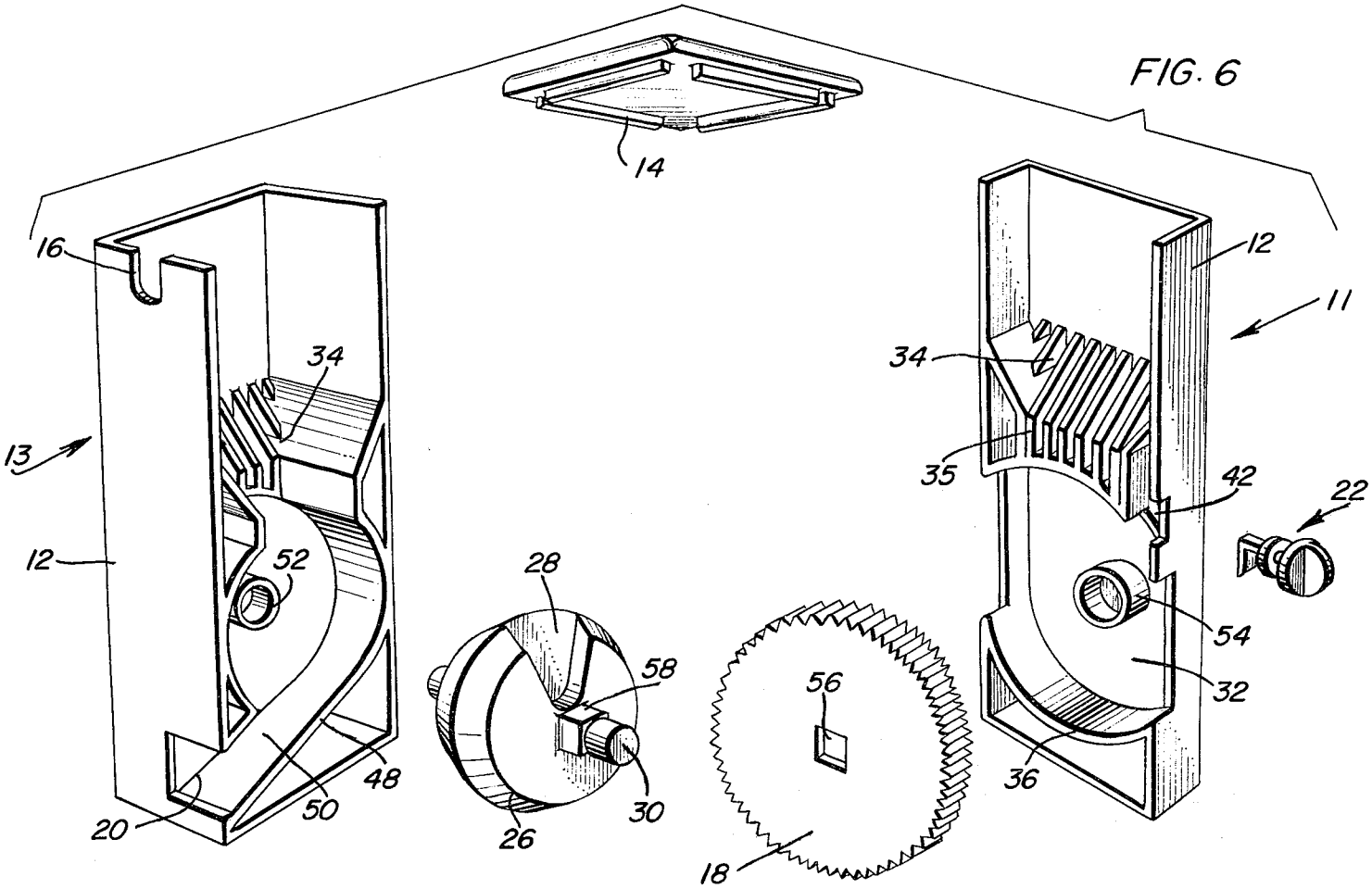
FIG. 6 is an exploded perspective view of the tablet dispensing device of the present invention illustrating the placement, general shape and structure of the component parts.

As illustrated in FIG. 2, tablet dispensing device 10 comprises a cavity 24 formed by lateral side walls 12 and removable lid 14 used for storing a plurality of tablets or pills. Adjacent and below storage cavity 24 are control know 18 and dispensing wheel 26, dispensing wheel 26 containing slots or recesses 28 for receiving tablets from storage cavity 24. Control knob 18 and dispensing wheel 26 are interconnected by a rotatable axle 30 which enables rotation of dispensing wheel 26 when control knob 18 is moved or turned. Placed between storage cavity 24 and cavity 32 which provides the space for control knob 18 and dispensing wheel 26 in the enclosure of dispensing device 10 is placed funnel means 34 including neck 35 which directs tablets from storage cavity 24 to recesses 28 of dispensing wheel 26. Cavity 32 is formed in part by the bottom of neck 35, lateral side walls 12 and internal laterally extending wall means 36 formed in enclosure half 11 as shown in FIG. 6. As illustrated in FIG. 2, pivotal locking device 22 is formed of external finger control piece 38 and internal finger extension 40 rotatable in opening 42 formed in one of lateral side walls 12 of enclosure half 11. Extension 40 of pivotable locking device 22 is bent so as to engage a groove 44 in the knurled surface of control knob 18. By turning control 38 of locking device 22, extension 40 can be engaged or disengaged from groove 44 in control knob 18, thus either enabling dispensing of the tablet or preventing the inadvertent discharge of a tablet dispensing device 10. Preferably, dispensing wheel 26 includes two recesses 28 spaced on opposite faces of dispensing wheel 26 and at approximately 180° angle from each other as illustrated in FIG. 2 by the upwardly open solid line and the downwardly open dotted line.

Figure 3:
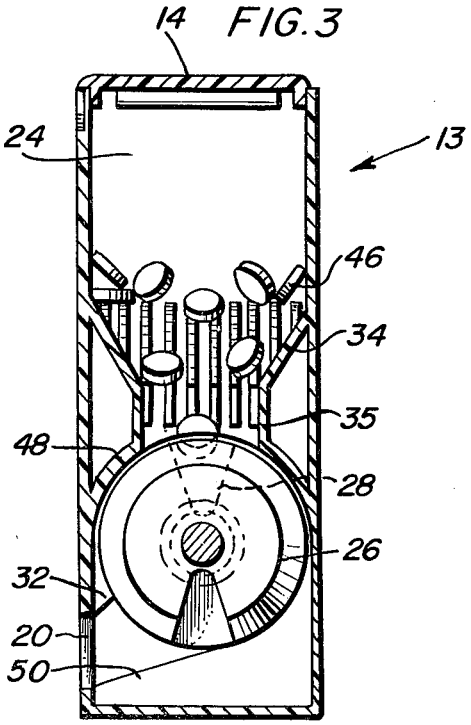
FIG. 3 is a longitudinal sectional view of the tablet dispensing device of the present invention taken generally along line 3—3 of FIG. 1.

In FIG. 3 tablets or pills 46 are being directed to recess 28 in tablet dispensing wheel 26 by funnel means 34. Cavity 32 is formed in part by wall means 48 on a lateral wall 12 in enclosure half 13 as shown in FIG. 6 directly opposite to the wall containing interior wall extension means 36. Wall means 48 forms a chute 50 which communicates with discharge opening 20 to eject the pills from recess 28 of dispensing wheel 26. By rotation of dispensing wheel 26 180°, tablets 46 which are stored in cavity 24 are directed to recess 28 through funnel means 34 and neck 35 and conveyed to chute 50 whereupon tablets 46 fall from recesses 28 due to gravity and are conveyed to discharge opening 20 by chute 50 whereupon a tablet 46 is ejected from dispensing device 10. Recesses 28 are preferably of a size to accommodate only one tablet or pill thus providing a predetermined quantity of tablets 46 for each 180° turn of dispensing wheel 26 by the appropriate amount of movement of control knob 18.

Figure 4:
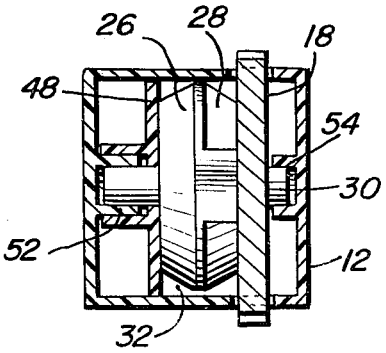
FIG. 4 is a transverse sectional view taken generally along line 4—4 of FIG. 1 and showing the relative placement of the dispensing wheel and control knob in the enclosure of the dispensing device.

FIG. 4 illustrates the relative placement of dispensing wheel 26 and control knob 18, such placement enabling dispensing wheel 26 to be rotated by manual manipulation of control knob 18. As seen in FIG. 4, cavity 32 which contains dispensing wheel 26 and control knob 18 is formed in part by lateral side wall 12 at the right of the Figure and wall means 48 at the left. Included in opposite left and right lateral wall means 12 are left and right socket means 52 and 54, respectively, which receive rotatable axle 30 passing through and interconnecting dispensing wheel 26 and control knob 18. Axle 30 may be a separate rotatable pin or integral part of either dispensing wheel 26 or control knob 18.

Figure 5:
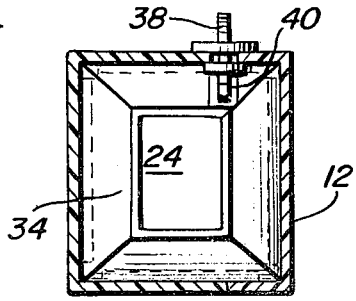
FIG. 5 is a transverse sectional view of the dispensing device of the present invention taken generally along line 5—5 of FIG. 5 and showing the storage cavity and funnel means of the dispensing device.

FIG. 5 illustrates funnel means 34 and storage cavity 24 of the present invention and shows the insertion of locking device 22 in lateral wall means 12.

FIG. 6 illustrates how each of the component parts are assembled to form the dispensing device 10 of the present invention. As can be seen, right enclosure 11 includes a portion of lateral wall means 12 to form a portion of storage cavity 24. A portion of funnel means 34 is an integral molded portion of enclosure half 11 and along with joint lateral wall portions 12 and internal laterally extending wall means 36 forms a portion of cavity 32, which portion holds control knob 18. Pivotable locking device 22 is inserted in cutout portion or opening 42 formed in lateral side wall 12 of enclosure half 11. Right socket 54 receives axle 30, shown as an integral part of dispensing wheel 26. Enclosure half 13 includes wall means 48 which forms a portion of cavity 32 which holds dispensing wheel 26. Wall means 48 is also forms chute 50 which communicates with discharge opening 20 formed by a cutout portion in lateral wall 12 of enclosure half 13. Left socket 52 also receives rotatable axle 30. Enclosure half 13 also includes a portion of funnel means 34. The device is formed by placing control knob 18 on axle 30 of dispensing wheel 26 such as by square recess 56 formed in control knob 18 receiving square extension 58 of axle 30. Control knob 18 is placed in the cavity 32 formed by right enclosure 11 and dispensing wheel 26 is placed in cavity 32 formed in enclosure half 13. Locking device 22 is placed in engagement with control knob 18 and halves 11 and 13 are assembled. Removable lid 14 covers the fully enclosed device to enable the storing and replacement of the tablets in storage cavity 24. As can be seen in FIG. 6, the funnel means 34 and the wall structures that form cavity 32 can be formed as an integral part of enclosure halves 11 and 13, although funnel means 34 and cavity 32 can be formed from separate pieces laterally extending from the internal surfaces of lateral walls 12. The component parts of the device are preferably formed from synthetic plastic materials which are lightweight and durable.

When control piece 38 of locking device 22 is turned so as to release extension 40 from groove 44 of control knob 18, control knob 18 is free to rotate. Movement of control knob 18 by a finger or thumb of a user moves dispensing wheel 26. Control knob 18 is moved long enough so that dispensing wheel 26 will move at least 180° to receive a tablet from cavity 24 and release it to chute 50.

The foregoing is considered as illustative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device comprising an enclosure formed by lateral wall means and having a top for covering said enclosure, a first cavity for storing a plurality of tablets in said enclosure, a second cavity adjacent to and below said first cavity and containing therein a dispensing wheel provided with at least one recess to receive at least one tablet from said first cavity, a control knob rotatably associated with said dispensing wheel, a portion of said control knob extending exteriorly from said enclosure, a chute opening into the bottom of said second cavity and extending to a discharge opening formed in one of said lateral wall means, and a pivotable locking means being selective engageable with said control knob to enable said control knob to be rotated only when said locking means is out of engagement with said control knob and to prevent rotation of said control knob only when said pivotable locking means is in engagement with said control knob.

2. A tablet dispensing device comprising an enclosure formed by lateral wall means and a lid covering said enclosure, said enclosure including a first cavity for storing tablets, a second cavity adjacent to said first cavity and containing therein a dispensing wheel provided with at least one recess to receive said tablets, a control knob adjacent said dispensing wheel having a portion extending exteriorly from said lateral wall means, said dispensing wheel and said control knob being interconnected by a rotatable axle placed through said dispensing wheel and said control knob, a chute placed adjacent a portion of said second cavity opposite said first cavity, a discharge opening in said lateral wall means associated with said chute, a funnel means placed between first cavity and said dispensing wheel, said control knob being movable by manipulation of said exterior extension causing said dispensing wheel to rotate and eject a tablet contained in said recess, a pivotable locking means associated with said control knob to prevent movement of said knob and inadvertent ejection of a tablet from the device, a knurled surface provided on said control knob, said pivotable locking means including an exterior portion and associated interior extension fitting into a groove formed in said knurled surface, said exterior portion being manipulatable to pivot said extension into engagement with said groove to prevent ejection of a tablet from the device and to pivot said extension out of said groove to enable movement of said control knob and associated movement of said dispensing wheel to eject a tablet from said device, two faces for said dispensing wheel, each face containing one recess spaced apart from the other by about 180°, and transverse extending interior wall means forming said second cavity in said enclosure.

3. The device of claim 2 wherein said enclosure comprises two halves, one of said halves includes a portion of said transverse extending interior wall means to provide space for said contol knob, the other half of said enclosure includes a portion of said transverse extending interior wall means to provide space for said dispensing wheel.

4. The device of claim 3 wherein said other half of said enclosure includes transverse extending wall means in the form of a chute spaced between said second cavity and said discharge opening.

5. The device of claim 4 wherein said rotatable axle is an integral part of said dispensing wheel and wherein said axle contains a polygonal-shaped portion able to be received in a similarly shaped recess in said control knob.

6. The device of claim 5 wherein said lid is removable to permit replacement of the tablets in said storage cavity.

7. The device of claim 2 wherein said enclosure includes means to provide space for said control knob, the other half of said enclosure includes a portion of said transverse extending means to provide space for said dispensing wheel.

8. The device of claim 2 wherein said enclosure includes means in the form of a chute spaced between said second cavity and said discharge opening.

9. The device of claim 2 wherein said rotatable axle is an integral part of said dispensing wheel and wherein said axle contains a polygonal-shaped portion for receiving a similarly shaped recess in said control knob.

10. The device of claim 2 wherein said lid is removable to permit replacement of the tablets in said storage cavity.

11. The device of claim 2 wherein a portion of said control knob extends exteriorly from said enclosure and said chute opens into a bottom of said second cavity and extends to a discharge opening formed in one of said lateral wall means.

* * * * *